US011218812B2

(12) United States Patent
Kagawa et al.

(10) Patent No.: US 11,218,812 B2
(45) Date of Patent: Jan. 4, 2022

(54) SPEAKER DEVICE

(71) Applicant: PANASONIC INTELLECTUAL PROPERTY MANAGEMENT CO., LTD., Osaka (JP)

(72) Inventors: Shinya Kagawa, Osaka (JP); Mitsukazu Kuze, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 4 days.

(21) Appl. No.: 16/825,547

(22) Filed: Mar. 20, 2020

(65) Prior Publication Data

US 2020/0314550 A1 Oct. 1, 2020

(30) Foreign Application Priority Data

Mar. 26, 2019 (JP) ..... JP2019-058445
Mar. 26, 2019 (JP) ..... JP2019-058470

(51) Int. Cl.
*H04R 9/06* (2006.01)
*H04R 9/02* (2006.01)

(52) U.S. Cl.
CPC ..... *H04R 9/063* (2013.01); *H04R 9/025* (2013.01)

(58) Field of Classification Search
CPC ..... H04R 9/063; H04R 9/025; H04R 9/02; H04R 9/045; H04R 9/06; H04R 7/00; H04R 1/227; H04R 7/122; H04R 2400/11
USPC ..... 381/400, 401, 402, 403, 405, 406, 407, 381/408, 409, 410, 411, 412, 413, 433
See application file for complete search history.

(56) References Cited

U.S. PATENT DOCUMENTS 6,404,896 B1 * 6/2002 Yoo ..... H04R 9/045 381/401
2013/0051604 A1 * 2/2013 Sakai ..... H04R 9/063 381/401
2013/0336518 A1 12/2013 Yamauchi et al.
2015/0312679 A1 * 10/2015 Little ..... H04R 7/16 381/398

FOREIGN PATENT DOCUMENTS

JP 06-013293 2/1994
JP 2012-199859 10/2012

* cited by examiner

*Primary Examiner* — Alexander Krzystan
*Assistant Examiner* — Julie X Dang
(74) *Attorney, Agent, or Firm* — Greenblum & Bernstein, P.L.C.

(57) ABSTRACT

A speaker device that includes: two magnetic circuits arranged side by side and each including a magnetic gap; two voice coil bodies each corresponding to a shape of the magnetic gap and arranged in the magnetic gap in an inserted state; a diaphragm to which the two voice coil bodies are coupled, the diaphragm having a width shorter than a length in a direction in which the two magnetic circuits are arranged; and a frame to which the diaphragm and the two magnetic circuits are attached. In the speaker device, the two voice coil bodies include two coils connected in series, the two coils being connected to a pair of input terminals for receiving an input of an electric signal, the pair of input terminals being disposed between the two voice coil bodies.

12 Claims, 12 Drawing Sheets

SPEAKER DEVICE

CROSS REFERENCE TO RELATED APPLICATIONS

The present application is based on and claims priority of Japanese Patent Application No. 2019-058470 filed on Mar. 26, 2019, and priority of Japanese Patent Application No. 2019-058445 filed on Mar. 26, 2019. The entire disclosure of the above-identified applications, including the specifications, drawings and claims is incorporated herein by reference in its entirety.

FIELD

The present disclosure relates to a speaker device.

BACKGROUND

Conventionally, there are speaker devices such as the speaker device described in Patent Literature (PTL) 1 in which a plurality of speaker units each including an elongated diaphragm having a plate-like shape, a voice coil, and a magnetic circuit are arranged in the longitudinal direction of the diaphragm and attached to one frame.

CITATION LIST

Patent Literature

PTL 1: Japanese Unexamined Patent Application Publication No. 2012-199859

SUMMARY

Technical Problem

However, the display device disclosed by the above-described PLT 1 can be improved upon.

In view of this, the present disclosure provides a speaker device which is capable of improving upon the above related art.

Solution to Problem

A speaker device according to one aspect of the present disclosure includes: two magnetic circuits arranged side by side and each including a magnetic gap; two voice coil bodies each corresponding to a shape of the magnetic gap and arranged in the magnetic gap in an inserted state; a diaphragm to which the two voice coil bodies are coupled, the diaphragm having a width shorter than a length in a direction in which the two magnetic circuits are arranged; and a frame to which the diaphragm and the two magnetic circuits are attached. In the speaker device, the two voice coil bodies include two coils connected in series, the two coils being connected to a pair of input terminals for receiving an input of an electric signal, the pair of input terminals being disposed between the two voice coil bodies.

Advantageous Effects

The speaker device according to one aspect of the present disclosure is capable of improving upon the above related art.

BRIEF DESCRIPTION OF DRAWINGS

These and other advantages and features of the present disclosure will become apparent from the following description thereof taken in conjunction with the accompanying drawings that illustrate a specific embodiment of the present disclosure.

FIG. 7 indicates a positional relationship between the diaphragm and the voice coil bodies of the speaker device according to the embodiment.

DESCRIPTION OF EMBODIMENTS

Figure 1:
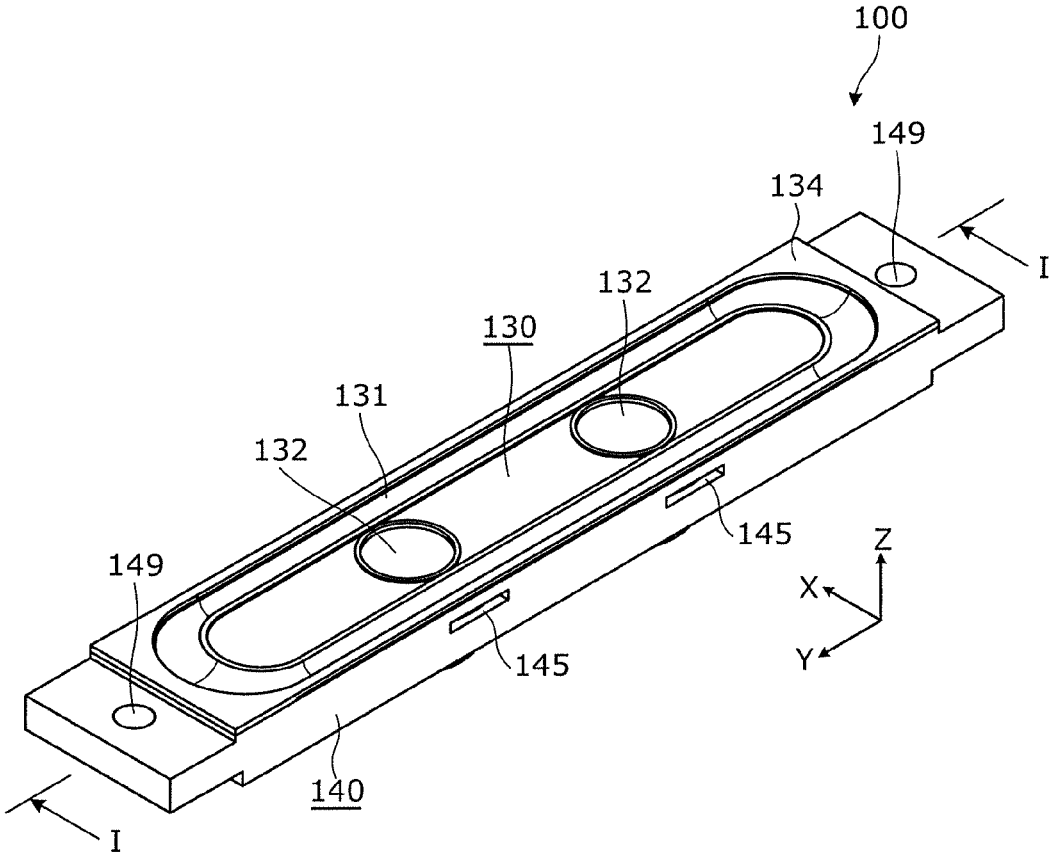
FIG. 1 is a perspective view illustrating a speaker device according to an embodiment.

A speaker device according to one aspect of the present disclosure includes: two magnetic circuits arranged side by side and each including a magnetic gap; two voice coil bodies each corresponding to a shape of the magnetic gap and arranged in the magnetic gap in an inserted state; a diaphragm to which the two voice coil bodies are coupled, the diaphragm having a width shorter than a length in a direction in which the two magnetic circuits are arranged; and a frame to which the diaphragm and the two magnetic circuits are attached. In the speaker device, the two voice coil bodies include two coils connected in series, the two coils being connected to a pair of input terminals for receiving an input of an electric signal, the pair of input terminals being disposed between the two voice coil bodies.

With this, there is a possibility that wiring of a signal wire can be facilitated and wiring to the outside can also be facilitated, by disposing a pair of input terminals for receiving an input of an electric signal such as an audio signal, at the center portion of the speaker device.

The diaphragm may have an elongated plate-like shape, and a distance from a center to an edge of the diaphragm in a longitudinal direction may be in a range of from 2.27 times or more to 2.74 times or less a length from the center of the diaphragm to a winding axis of one of the two voice coil bodies.

With this, there is a possibility that the acoustic characteristics are improved.

A cross-sectional shape of each of the two coils perpendicular to a winding axis direction may be one of an ellipse, an oval, and a rectangle with rounded corners.

With this, there is a possibility that the acoustic characteristics are improved.

Winding directions of the two coils may be same.

With this, it is possible to use the same coils, and to reduce the total number of components of different types.

Magnetization directions of the two magnetic circuits may be same.

With this, it is possible to use the same magnetic circuits, and it may be possible to facilitate the assembly.

The two voice coil bodies may respectively include extension portions from which signal wires extend, and the two voice coil bodies may be arranged with the extension portions facing each other.

With this, it is possible to increase the possibility of simplifying the wiring.

The speaker device may further include a damper that has an annular shape and includes dividing portions, the dividing portions dividing the damper in a circumferential direction and being arranged such that the signal wires pass through the dividing portions.

The two voice coil bodies may each include tongue pieces that are end portions of a bobbin, and are attached to the diaphragm by being bent outwardly in a radial direction.

The diaphragm may have an elongated plate-like shape.

Among the tongue pieces: a tongue piece that protrudes in a width direction of the diaphragm may be shorter than a tongue piece that protrudes in a longitudinal direction of the diaphragm. Alternatively, no tongue piece that protrudes in the width direction may be included in the tongue pieces.

With this, there is a possibility that the width of the speaker device can be reduced.

Hereinafter, embodiments will be described in detail with reference to the drawings.

Each of the embodiments described below shows a general or specific example. The numerical values, shapes, materials, structural components, the arrangement and connection of the structural components, steps, the processing order of the steps, and so on, shown in the following embodiments are mere examples, and therefore do not limit the present disclosure. In addition, among the structural components in the following embodiments, structural components not recited in any one of the independent claims are described as arbitrary structural components. In addition, each diagram is a schematic diagram and not necessarily strictly illustrated. Furthermore, in the respective figures, the same numerical sign is given to identical structural components.

Hereinafter, embodiments of a speaker device will be described with reference to the drawings.

Figure 2:
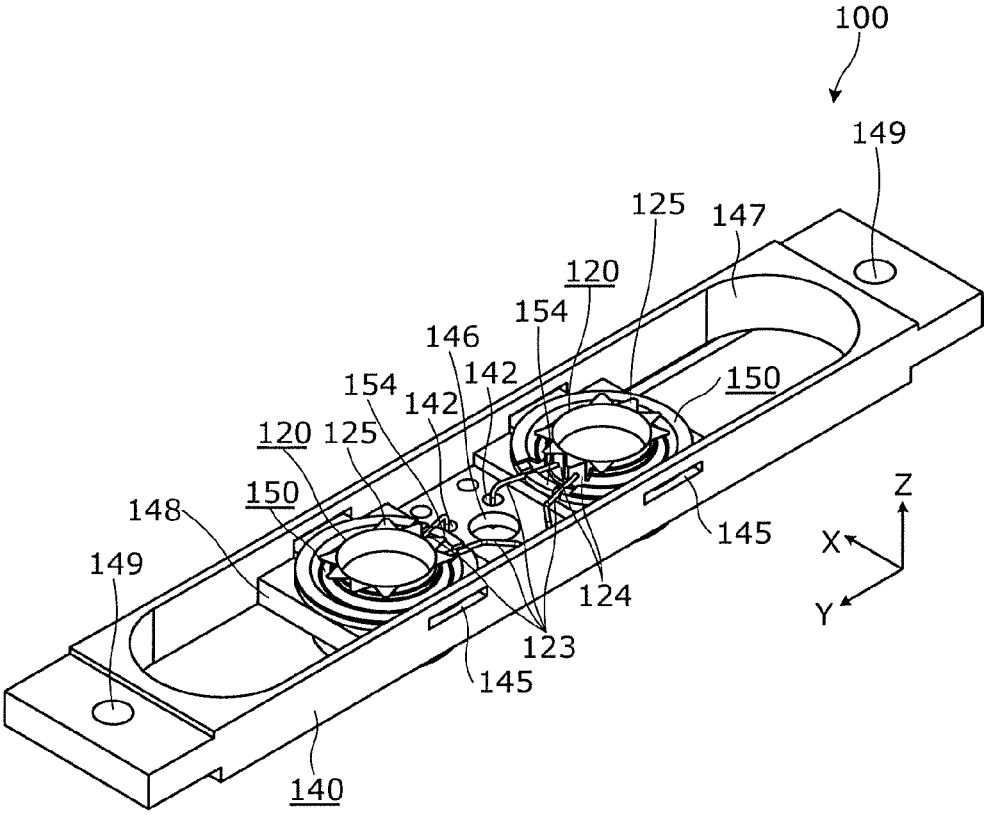
FIG. 2 is a perspective view illustrating an inside of the speaker device according to the embodiment with a diaphragm being omitted.
Figure 3:
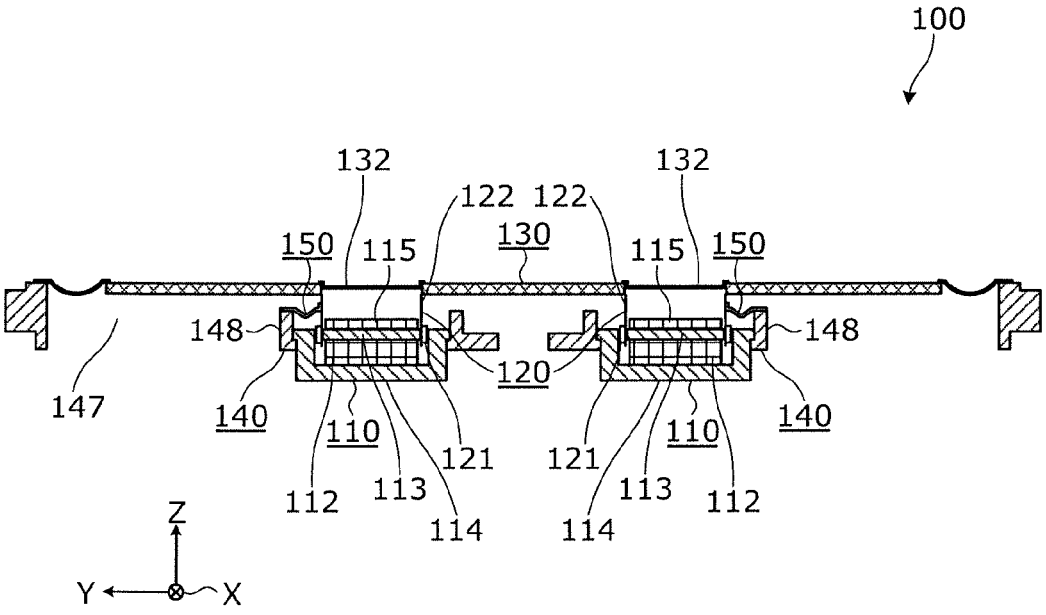
FIG. 3 is a cross-sectional view of the speaker device according to the embodiment, taken along line I-I indicated in FIG. 1.
Figure 4:
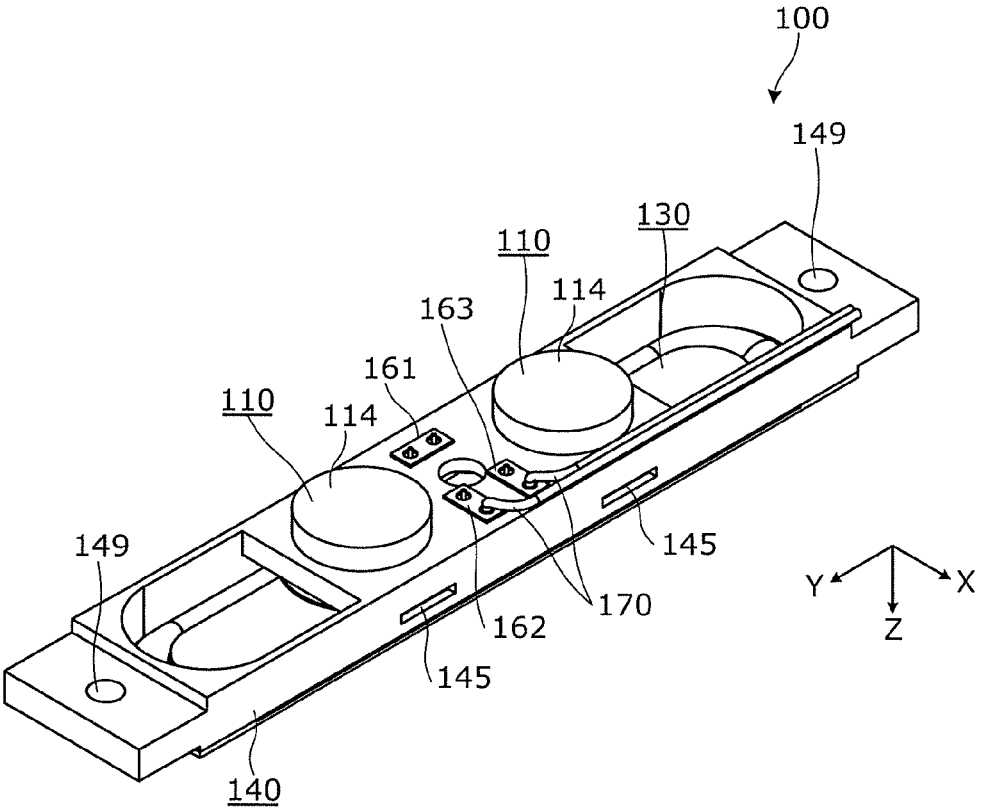
FIG. 4 is a perspective view illustrating the speaker device according to the embodiment from a rear side.

FIG. 1 is a perspective view illustrating a speaker device according to the embodiment. FIG. 2 is a perspective view illustrating an inside of the speaker device according to the embodiment with a diaphragm, etc. being omitted. FIG. 3 is a cross-sectional view illustrating a cross-sectional surface of the speaker device according to the embodiment, taken along line I-I indicated in FIG. 1. FIG. 4 is a perspective view illustrating the speaker device according to the embodiment from a rear side.

According to the present embodiment, speaker device 100 includes two magnetic circuits 110, two voice coil bodies 120, one diaphragm 130, and frame 140. In addition, speaker device 100 includes connecting component 161, positive input terminal 162 that is one of a pair of input terminals, and negative input terminal 163 that is the other of the pair of input terminals. Speaker device 100 is a speaker device attachable to a moving body such as an automobile, and is a thin speaker device that can be embedded in a limited space inside the moving body.

Magnetic circuit 110 is a component that generates a steady magnetic flux. Magnetic circuit 110 is attached to frame 140 so as to be located behind diaphragm 130, and includes an annular magnetic gap facing diaphragm 130. The magnetic gap is an air gap where the steady magnetic flux is generated in a direction crossing the magnetic flux generated in voice coil body 120. In this specification, the front refers to a direction in which the sound of speaker device 100 is emitted, and the rear refers to a direction opposite thereto.

According to the present embodiment, magnetic circuit 110 is of an internal magnet type as illustrated in FIG. 3, and includes magnet 112, sub magnet 115, top plate 113, and yoke 114. A magnetic gap which is an air gap having an annular space is formed between yoke 114 and top plate 113.

Top plate 113 and yoke 114 each include a ferromagnetic material. The shapes of top plate 113 and yoke 114 are not particularly limited. According to the present embodiment, top plate 113 has a disk-like shape, and is disposed on a surface of magnet 112 on the side close to diaphragm 130. York 114 has a cylindrical shape with a bottom and coaxially houses magnet 112.

Magnet 112 is a permanent magnet having a columnar shape. Sub magnet 115 is a permanent magnet having a disk-like shape. As magnet 112 and sub magnet 115, for example, a neodymium magnet having high magnetic energy may be used. With this, the thickness of magnet 112 can be reduced, and it is thus possible to reduce the overall thickness of speaker device 100. Furthermore, weight reduction can also be realized.

One end of magnet 112 in the thickness direction (the Z-axis direction in the diagram) is an N pole, and the other end is an S pole. Top plate 113 is fixed to the surface of one pole side of magnet 112, and yoke 114 is fixed to the surface of the other pole side of magnet 112. In addition, sub magnet 115 having a disk-like shape is disposed on top plate 113 on the side opposite to magnet 112. A strong magnetic flux is generated in the magnetic gap by magnet 112 and sub magnet 115. The method of fixing top plate 113, magnet 112, yoke 114, and sub magnet 115 is not particularly limited, but in the case of the present embodiment, they are fixed by an adhesive.

According to the present embodiment, the two magnetic circuits 110 have the same magnetization direction with respect to yoke 114. In other words, magnets 112 are arranged such that the magnetic directions from top plate 113 to yoke 114 are the same. In addition, the two magnetic circuits 110 are mounted on one frame 140. More specifically, the two magnetic circuits 110 are attached to one pedestal portion 148 that is bridged on housing 147 of frame 140 in the width direction, at the center in the longitudinal direction of housing 147 of frame 140. Wiring holes 142 are provided between the two magnetic circuits 110 of pedestal portion 148.

It should be noted that top plate 113, magnet 112, yoke 114, and sub-magnet 115 may be fixed using fastening members such as screws and rivets. In addition, the type of magnetic circuit 110 included in speaker device 100 is not particularly limited, and a magnetic circuit of an external magnet type may be employed.

Voice coil body 120 is a component that has one end located in the magnetic gap of magnetic circuit 110 and the other end attached to diaphragm 130. Voice coil body 120 vibrates using power generated in the winding axis direction (the Z-axis direction in the diagram) by a magnetic flux between the current of an electric signal to be input and the magnetic gap. The winding axis (center axis) of voice coil body 120 is arranged in the direction of vibration (amplitude) of diaphragm 130 (the Z-axis direction in the diagram), and is orthogonal to the direction of the magnetic flux inside the magnetic gap. According to the present embodiment, voice coil body 120 includes coil 121 prepared by winding a single metallic wire material several times into loops (into a cylindrical shape), and bobbin 122 around which the wire material is wound. Bobbin 122 is a tubular component that includes a material such as aluminum, a resin, etc. The front end portion of bobbin 122 is bonded to diaphragm 130 and the rear end portion thereof is disposed inside the magnetic gap.

At the end portion of bobbin 122 on the side of the diaphragm 130 (front side), there are tongue pieces 125 which are provided by being bent outwardly in the radial direction of bobbin 122 (see FIG. 2). Tongue piece 125 is for increasing the area contacting with diaphragm 130 and increasing the adhesion strength between diaphragm 130 and bobbin 122. According to the present embodiment, tongue pieces 125 are formed by providing triangular cuts in a circumferential direction at one end portion of bobbin 122 having a cylindrical shape, and bending the remaining triangular portions so as to open outward. Tongue piece 125 that is bent in the width direction of diaphragm 130 having an elongated rectangular shape (the X-axis direction in the diagram) is cut to be shorter than tongue piece 125 that is bent in the longitudinal direction of diaphragm 130 (the Y-axis direction in the diagram), or cut to be removed. With this configuration, it is possible to increase the adhesion strength between diaphragm 130 and bobbin 122 by tongue piece 125 and to employ bobbin 122 having a large diameter close to the length in the width direction of diaphragm 130 having an elongated rectangular shape.

It should be noted that the shape of tongue piece 125 is not limited to a triangular shape, and may be any shape such as a quadrilateral shape.

From voice coil body 120, both ends of the wire material included in coil 121 extend from extension portions 124 (see FIG. 2) as signal wires 123 (see FIG. 2). Signal wires 123 are referred to as flexible wires, tinsel wires, or the like. Signal wires 123 are wired through radially extending grooves provided in a cylindrical portion of frame 140 to which a damper is attached. Signal wires 123 are electrically connected to positive input terminal 162 and negative input terminal 163 attached to the outer surface of frame 140 via wiring holes 142 provided in frame 140. External wiring 170 connected to an amplifier or the like is electrically connected to the two input terminals. It should be noted that wiring holes 142 are each sealed with a terminal, solder, or the like.

Figure 5:
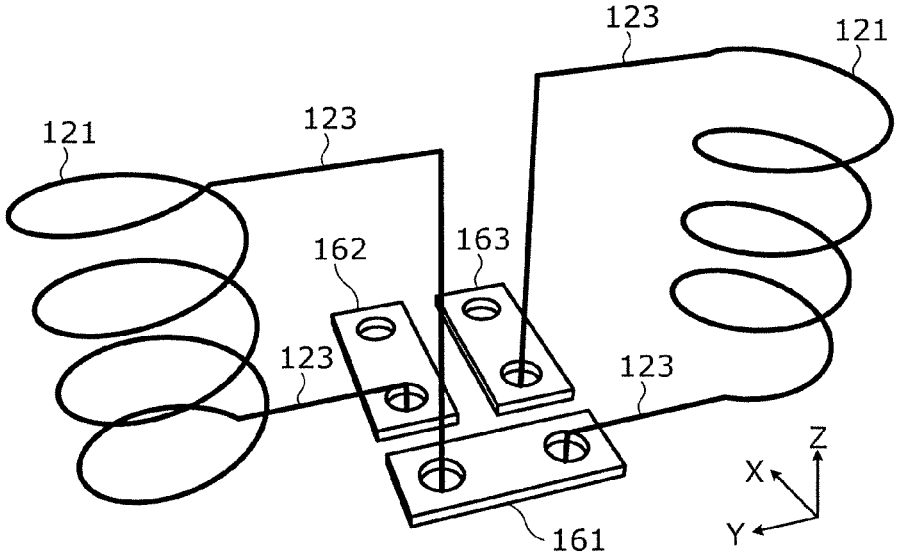
FIG. 5 is a perspective view schematically illustrating two coils, a connecting component, a positive input terminal, and a negative input terminal.

FIG. 5 is a perspective view schematically illustrating two coils 121, connecting component 161, positive input terminal 162, and negative input terminal 163. As illustrated in the diagram, coils 121 included in the two voice coil bodies 120 are wound in the same direction and connected in series. In other words, when a direct current is applied from one open end of the two coils 121 connected in series to the other open end, the magnetic fields generated in the respective coils 121 are directed in the same direction.

In addition, two of signal wires 123 extending from the two coils 121 are electrically connected by connecting component 161 attached to the outside of frame 140. The method of connecting signal wires 123 and connecting component 161 is not particularly limited, but in the case of the present embodiment, signal wires 123 and connecting component 161 are connected by a solder (not illustrated).

Connecting component 161 is a component including a conductor. According to the present embodiment, a component that is a rectangular copper plate provided with through holes at positions corresponding to wiring holes 142 is employed as the connecting component 161.

The other two of signal wires 123 extending from the two coils 121 are electrically connected respectively to positive input terminal 162 and negative input terminal 163 attached to the outside of frame 140. Positive input terminal 162 and negative input terminal 163 are terminals to which an audio signal is input, and external wires 170 (see FIG. 4) are electrically connected thereto. According to the present embodiment, connecting component 161, positive input terminal 162, and negative input terminal 163 have the same shape. In addition, connecting component 161, positive input terminal 162, and negative input terminal 163 may be insert-molded together with frame 140 made of resin.

Damper 150 is a component which has flexibility and resilience, is attached in a bridging manner between frame 140 and voice coil body 120, and assists the linear movement of voice coil body 120 of speaker device 100 during driving to adjust acoustic characteristics. Damper 150 is deformed, during driving of speaker device 100, in accordance with the vibration of voice coil body 120 in the winding axis direction (in the Z-axis direction in the diagram), and maintains voice coil body 120 in the neutral position when an audio signal is not input to voice coil body 120.

The material included in damper 150 is not particularly limited, and may be arbitrarily selected according to desired acoustic characteristics such as a material obtained by impregnating a cloth with a resin, rubber, or an elastomer.

According to the present embodiment, damper 150 has dividing portion 154 (see FIG. 2) that divides a part of a ring shape in the circumferential direction at a position corresponding to extension portion 124 of signal wire 123 extending from voice coil body 120. According to the present embodiment, dividing portion 154 is a portion that completely divides, in the circumferential direction, damper 150 having an annular shape, and is different from a notch that leaves a part of damper 150 as a complete annular shape. Damper 150 has a C-shape in a plan view when viewed from the Z-axis direction due to the presence of dividing portion 154.

At least a part of damper 150 is attached to voice coil body 120 so as to be located at the same position as extension portion 124 in the vibration direction of voice coil body 120 (the Z-axis direction in the diagram). Dividing portion 154 is disposed so as to overlap extension portion 124 in a radial direction (the Y-axis direction in the diagram) orthogonal to the vibration direction of voice coil body 120. Dividing portion 154 is a portion on which signal wire 123 is wired so as to pass therethrough, as illustrated in FIG. 2.

As described above, by providing damper 150 having the annular shape with dividing portion 154 that divides damper 150 in the circumferential direction, it is possible to avoid interface between signal wires 123 and damper 150 or diaphragm 130 even when the length in the winding axis direction of voice coil body 120 protruding from the magnetic gap is reduced. Therefore, it is possible to achieve desired acoustic characteristics even though speaker device 100 is thin.

Figure 6:
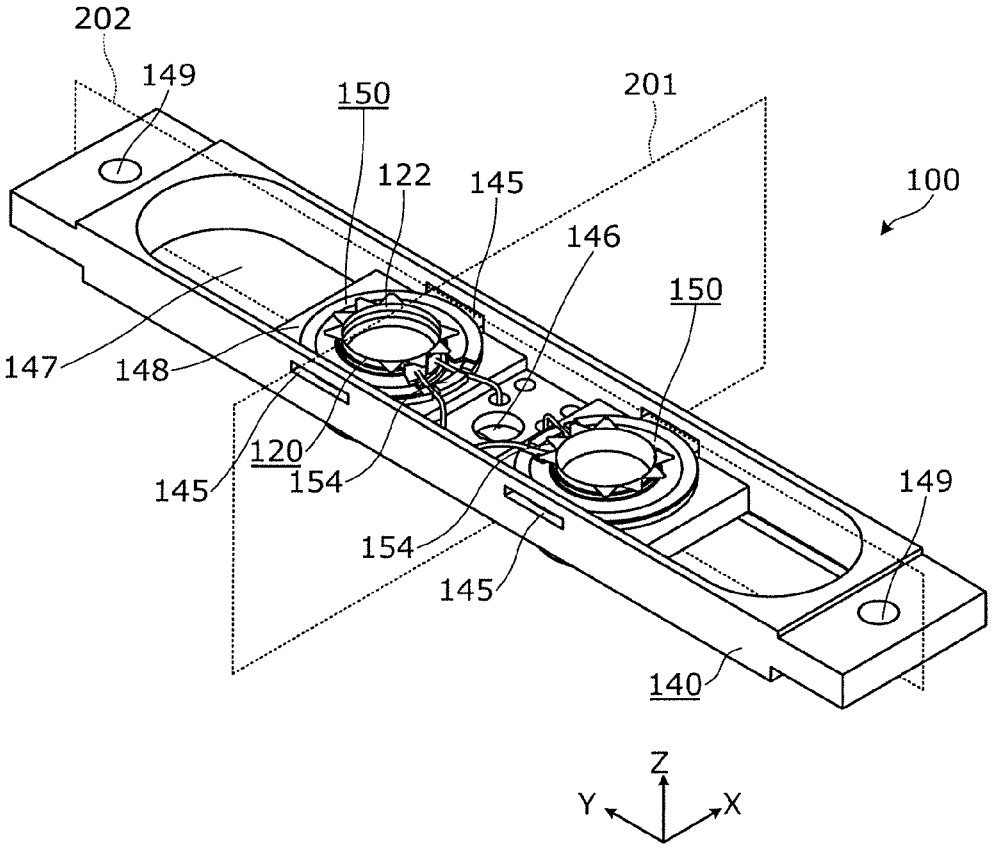
FIG. 6 is a perspective view illustrating the symmetry of the speaker device according to the embodiment.

According to the present embodiment, two dampers 150 included in speaker device 100 are arranged to be plane-symmetric with respect to first virtual surface 201 that virtually bisects diaphragm 130 in the longitudinal direction as illustrated in FIG. 6. According to the above-described configuration, it is possible to cancel the influence of dividing portion 154 provided on damper 150 on the vibration of voice coil body 120, and to improve the acoustic characteristics of speaker device 100. In addition, according to the present embodiment, damper 150 is also plane-symmetric with respect to second virtual plane 202 that virtually bisects diaphragm 130 in the width direction.

The two magnetic circuits 110 are also plane-symmetric with respect to each of first virtual plane 201 and second virtual plane 202. It should be noted that, although overall shapes and positions of extension portions 124 of voice coil bodies 120 are plane-symmetric with respect to each of first virtual plane 201 and second virtual surface 202, the winding directions of coils 121 are not plane-symmetric with respect to first virtual plane 201. Since extension portions 124 are arranged to face each other according to the present embodiment, signal wires 123 extending from extension portions 124 are arranged in a concentrated manner at the center of frame 140. Accordingly, connecting component 161 that connects signal wires 123 for connecting coils 121 in series is also located at the center of frame 140 and between the two voice coil bodies 120, and thus it is possible to connect signal wires 123 extending from the two coils 121 in a state in which the lengths of signal wires 123 are short, and to place signal wires 123 in a simple wiring state in frame 140.

It should be noted that the shape of damper 150 is not particularly limited. For example, as illustrated in FIG. 3, the cross section of a part of damper 150 is not limited to a V-shape, and may be a concentric wavy shape (ripple shape), or the like. In addition, damper 150 may be mounted at a location other than bobbin 122. Furthermore, the mounting position of damper 150 is not limited to bobbin 122, and damper 150 may connect diaphragm 130 and frame 140.

Diaphragm 130 is a component to which the distal end of voice coil body 120 is coupled, and is displaced in the front-rear direction (the Z-axis direction in the diagram) relative to the neutral position, according to the vibration of voice coil body 120, thereby vibrating air to generate a sound. According to the present embodiment, diaphragm 130 has a plate-like shape, and an outer shape of diaphragm 130 in a plan view as viewed from the vibration direction is a track shape. The outer periphery of diaphragm 130 is attached to the front end surface of a wall portions of frame 140 via edge 131 having greater flexibility and resilience than diaphragm 130. In addition, a portion corresponding to edge 131 attached to frame 140 is protected by gasket 134.

Figure 7:
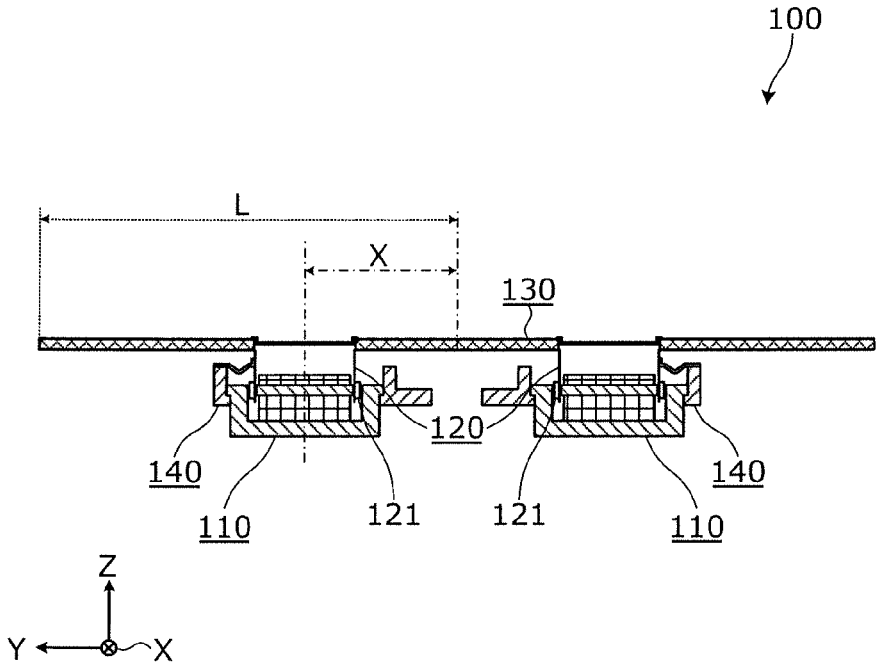
FIG. 7 is a cross-sectional view of the speaker device according to the embodiment, taken along line I-I indicated in FIG. 1.
Figure 8:
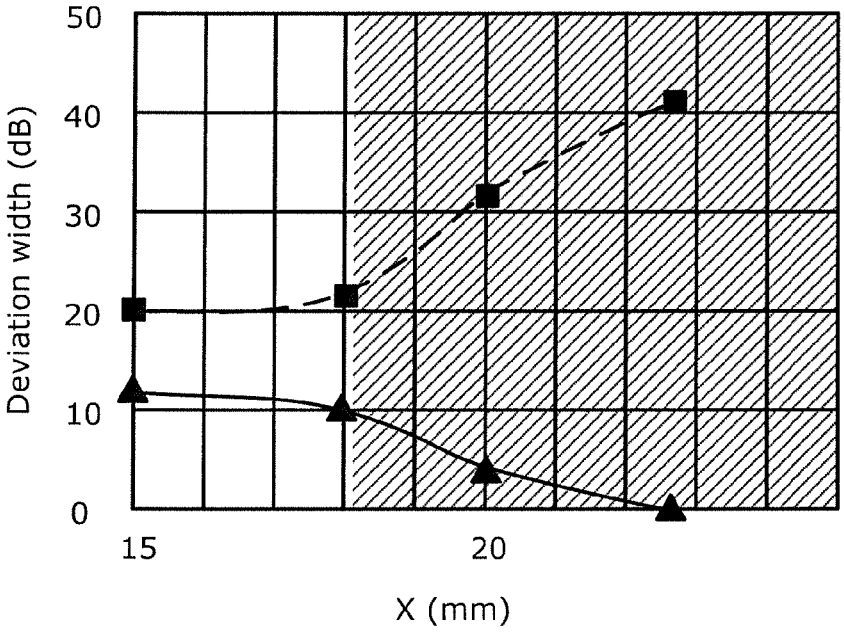
FIG. 8 is a graph indicating a relationship between a deviation width and a length from the center of the diaphragm to a winding axis of the voice coil body when the length of the diaphragm is fixed.

Two voice coil bodies 120 are arranged side by side in the longitudinal direction of diaphragm 130 (the Y-axis direction in the diagram) and coupled to diaphragm 130. As illustrated in FIG. 7, distance L from the center of diaphragm 130 to the edge crossing second virtual plane 202 in the longitudinal direction is set within a range of from 2.27 times or more to 2.74 times or less length X from the center of diaphragm 130 to the winding axis of voice coil body 120. FIG. 8 is a graph illustrating a deviation width when distance L from the center of the diaphragm to the edge in the longitudinal direction is 41 mm and length X from the center of the diaphragm to the winding axis of the voice coil body is changed. The solid line indicates the deviation width in a primary resonance mode, and the broken line indicates the deviation width in a secondary resonance mode. A component in which a skin layer that includes metal, paper, fiber-reinforced resin including carbon fiber reinforced plastics (CFRP), or the like is provided on both surfaces of a core layer that includes a resin, a foamed resin, or a resin having a honeycomb structure is used as diaphragm 130. As illustrated in the diagram, in the case where $L/X<2.27$ (hatched portion in FIG. 8), it is difficult to suppress both the primary resonance mode and the secondary resonance mode, leading to a deterioration in the acoustic characteristics. In addition, in the case where $L/X<2.74$, the distance between the two voice coil bodies 120 becomes too short.

The shape of diaphragm 130 in a plan view is not particularly limited, and may be an ellipse including a track shape, etc., or a quadrilateral shape. The material included in diaphragm 130 is not particularly limited, and examples thereof include paper, resin, etc. In addition, diaphragm 130 is provided with through holes for attaching voice coil bodies 120, and caps 132 (see FIG. 1) for sealing the through hole are attached thereto. Cap 132 prevents foreign matter from entering the magnetic gap.

Frame 140 is a structural component that holds magnetic circuit 110, diaphragm 130, and damper 150. Although the shape of frame 140 is not particularly limited, in the case of the present embodiment, frame 140 has a rectangular plate shape, and includes mounting holes 149 provided at both ends in the longitudinal direction. Frame 140 includes housing 147 which has a track shape in a plan view, and includes a partially penetrating portion in the thickness direction. Housing 147 includes pedestal portion 148 having a quadrilateral shape, in the middle portion in the longitudinal direction. Pedestal portion 148, to which magnetic circuit 110, damper 150, etc. are mounted, is disposed in a bridging manner in the width direction of housing 147. Pedestal portion 148 is provided with wiring holes 142.

Frame 140 includes first work holes 145 that are penetrating therethrough, in a central portion of the side wall. Second working hole 146 is provided in pedestal portion 148 between the two dampers 150. First working holes 145 and second working hole 146 are holes for inserting jigs, tools, etc., at the time when damper 150 and the like are mounted on pedestal portion 148 of frame 140. First working holes 145 and second working hole 146 provided in frame 140, and an end opening of housing 147 opposite to the end to which diaphragm 130 is attached are openings communicating with dividing portion 154. Accordingly, there is a possibility that dust may enter from the openings and reach the magnetic gap. In view of the above, according to the present embodiment, a cover (not illustrated) for preventing intrusion of dust is attached to the openings of first working holes 145, second working hole 146, and the opening of housing 147 so as to cover the openings. The cover is not particularly limited as long as it can prevent intrusion of dust, but a mesh member that allows air to pass therethrough and can prevent intrusion of dust may be used. It is possible to adjust the acoustic characteristics of speaker device 100 by such a cover.

As in the above-described embodiment, speaker device 100 is provided in which two voice coil bodies 120 are coupled to one diaphragm 130, and coils 121 are connected in series.

In particular, when the winding directions of coils 121 included in two voice coil bodies 120 are the same and the directions of the magnetic fields in the magnetic gaps of the two magnetic circuits 110 are the same, it is possible to use components of the same standard as the two voice coil bodies 120 and magnetic circuits 110. It is thus possible to avoid mounting errors of magnetic circuits 110 and voice coil bodies 120 and to suppress the product cost.

In addition, by arranging extension portions 124 of the two voice coil bodies 120 to face each other, signal wires 123 extending from coil 121 can be shortened. It thus becomes possible to simplify the wiring of signal wire 123 in frame 140.

In addition, since tongue pieces 125 cause voice coil bodies 120 and diaphragm 130 to be coupled with a high bonding strength, it is possible to achieve high durability.

In addition, by attaching voice coil bodies 120 to diaphragm 130 at a position within a predetermined range, it is possible to vibrate diaphragm 130 that is relatively long and large by two voice coil bodies 120 while suppressing not only the primary resonance mode but also the higher-order resonance mode. Accordingly, it is possible to obtain a large sound volume with high acoustic characteristics even though speaker device 100 is a thin speaker device.

In addition, since damper 150 including dividing portion 154 that completely divides damper 150 in the circumferential direction is used, and damper 150 is disposed to be plane-symmetric with respect to first virtual surface 201, it is possible to cancel the influence of dividing portion 154, and to obtain desired acoustic characteristics.

In addition, since dividing portion 154 and extension portion 124 are arranged so as to overlap in the winding axis direction of coil 121, the distance between damper 150 and diaphragm 130 can be shortened, and thus it is possible to implement speaker device 100 of a thin type.

Next, a method for manufacturing the speaker device according to the embodiment will be described. FIG. 9 to FIG. 16 are cross-sectional perspective views sequentially illustrating the manufacturing processing of the speaker device.

Figure 9:
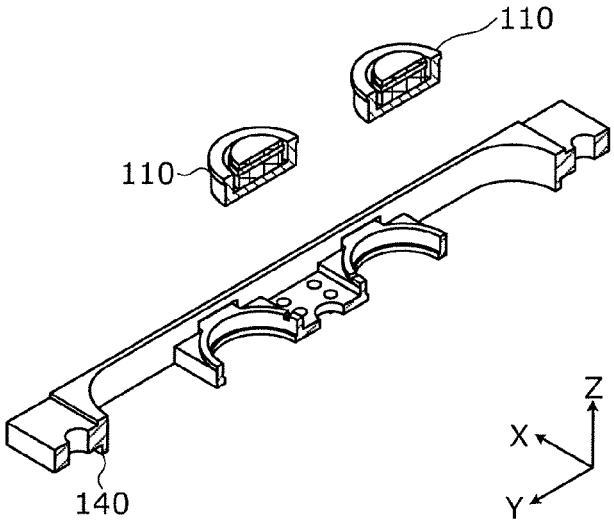
FIG. 9 is a cross-sectional perspective view illustrating a step of attaching magnetic circuits in the manufacturing processing of the speaker device according to the embodiment.

As illustrated in FIG. 9, two magnetic circuits 110 that have been separately assembled are respectively assembled at predetermined positions of frame 140. The method of fixing magnetic circuits 110 to frame 140 is not particularly limited, and examples thereof include bonding, press fitting, and the like.

Figure 10:
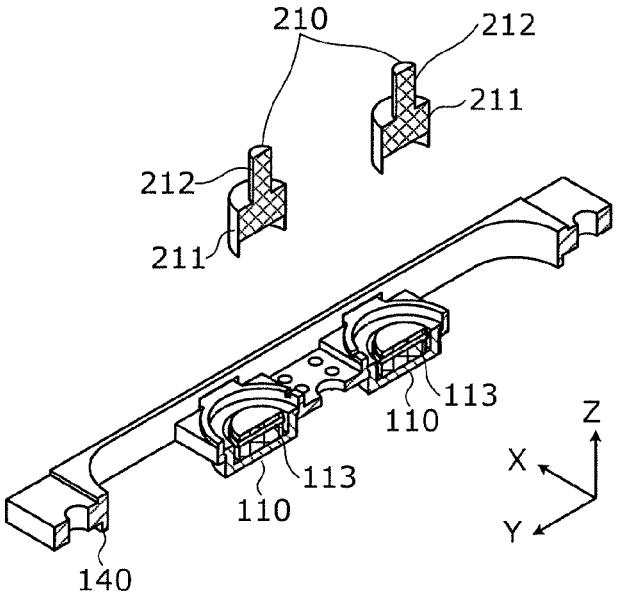
FIG. 10 is a cross-sectional perspective view illustrating a step of arranging jigs in the manufacturing processing of the speaker device according to the embodiment.

Next, as illustrated in FIG. 10, jigs 210 are inserted into the magnetic gaps. Jigs 210 arrange voice coil bodies 120 accurately in the magnetic gaps of the magnetic circuits 110. Jigs 210 each include: main body 211 having a cylindrical shape with a bottom; and gripper 212 for making it easier for an operator to hold jig 210. The outer peripheral surface of main body 211 is in a state of being fitted slidably, in the axial direction, with the inner peripheral surface of bobbin 122 of voice coil body 120. The inner peripheral surface of main body 211 is in a state of being fitted slidably, in the axial direction, with top plate 113 inside the magnetic gap. More specifically, by fitting jig 210 to top plate 113 inside the magnetic gap, the position of jig 210 with respect to top plate 113 is determined, and jig 210 functions as a guide (spacer) when voice coil body 120 is inserted into the magnetic gap.

Figure 11:
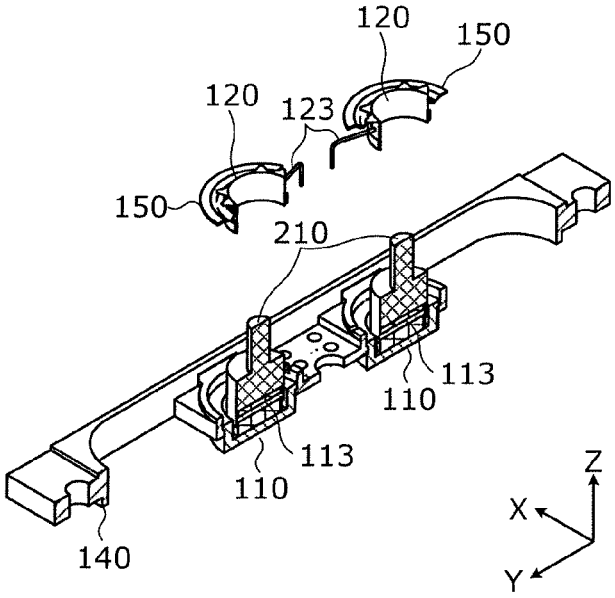
FIG. 11 is a cross-sectional perspective view illustrating a step of attaching voice coil bodies in the manufacturing processing of the speaker device according to the embodiment.

Next, as illustrated in FIG. 11, voice coil bodies 120 to which dampers 150 have been separately attached are inserted into the magnetic gaps so as to be fitted into jigs 210. Voice coil bodies 120 are each arranged at an appropriate position with respect to the magnetic gap by jig 210 in the radial direction. In addition, voice coil body 120 is arranged at an appropriate position in the axial direction by connecting damper 150 and frame 140. The method of fixing damper 150 and frame 140 is not particularly limited, and examples thereof include adhesion, etc.

Furthermore, at the time of arranging voice coil body 120, voice coil body 120 is arranged so that signal wire 123 passes through a groove extending in a radial direction in a cylindrical portion of frame 140 to which damper 150 is attached, and thus it is possible to arrange the two dampers 150 to be symmetrical with respect to first virtual plane 201 and second virtual plane 202.

In addition, when tongue piece 125 is formed on voice coil body 120, a plurality of triangular cuts are provided evenly in the circumferential direction at the end portion of bobbin 122 having a cylindrical shape, and the remaining triangular portion is bent outwardly as tongue piece 125. In the process of bending tongue piece 125, instead of bending tongue piece 125 until it becomes perpendicular to the axis of bobbin 122, tongue piece 125 is bent so as to be closer to diaphragm 130 as moving toward the outside in the radial direction of bobbin 122. In other words, tongue piece 125 is bent so as to be gradually away from the end portion of bobbin 122. In this manner, voice coil body 120 can be firmly attached to diaphragm 130. When attaching voice coil body 120 to diaphragm 130 to which edge 131 is attached, tongue piece 125 that interferes with edge 131 is cut off.

Figure 12:
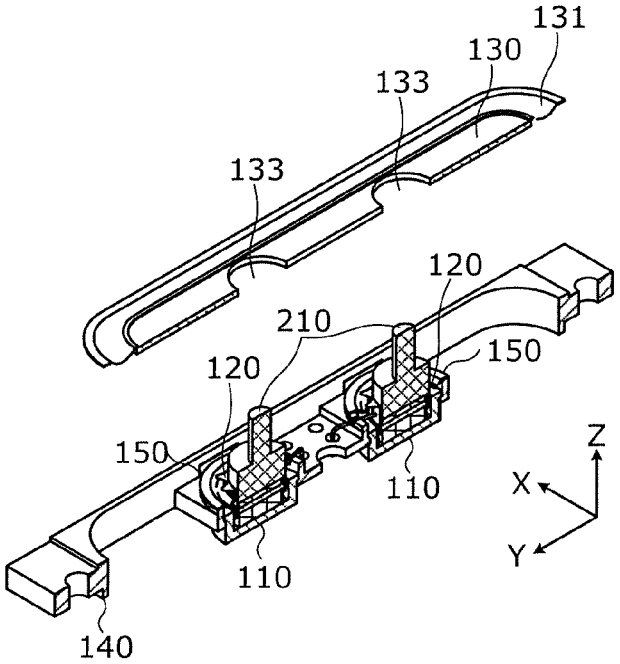
FIG. 12 is a cross-sectional perspective view illustrating a step of attaching a diaphragm in the manufacturing processing of the speaker device according to the embodiment.

Next, as illustrated in FIG. 12, diaphragm 130 to which edge 131 has been separately attached is attached to frame 140 via edge 131 so as to connect diaphragm 130 and voice coil body 120. At the time of attaching vibration plate 130, jig 210 is arranged so as to be fitted into through hole 133 provided in vibration plate 130. In this manner, by connecting diaphragm 130 and voice coil body 120 with jig 210 being inserted thereto, using an adhesive or the like, it is possible to attach voice coil body 120 to diaphragm 130 without shifting of voice coil body 120 with respect to the magnetic gap.

Figure 13:
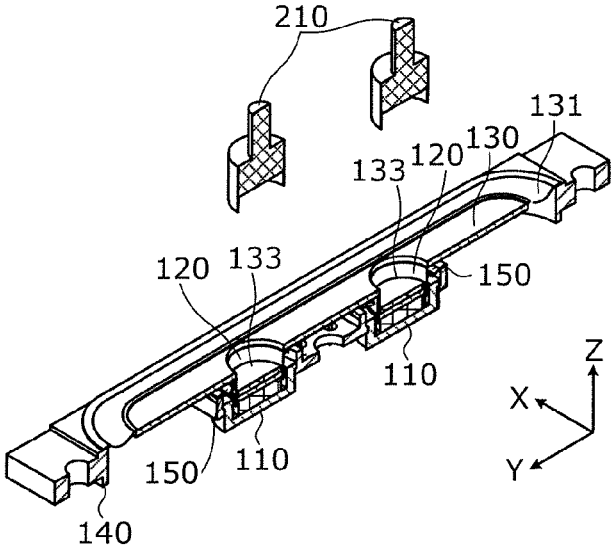
FIG. 13 is a cross-sectional perspective view illustrating a step of detaching the jigs in the manufacturing processing of the speaker device according to the embodiment.

Next, jigs 210 are removed as illustrated in FIG. 13. At this stage, since voice coil bodies 120 are fixed to frame 140 via damper 150 and also fixed to frame 140 via diaphragm 130 and edge 131, the positions of voice coil bodies 120 with respect to the magnetic gap are maintained.

Figure 14:
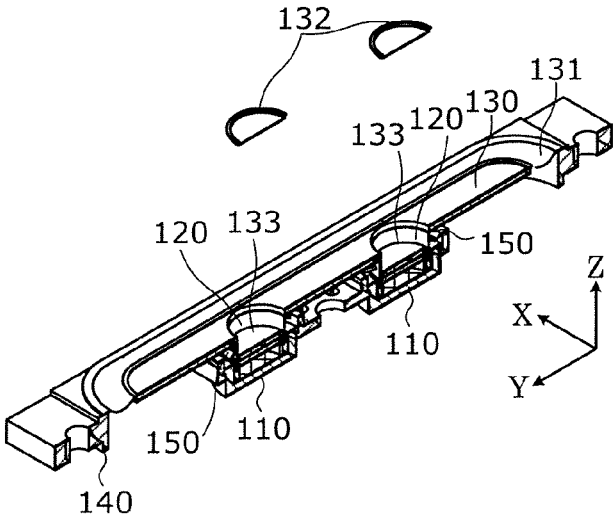
FIG. 14 is a cross-sectional perspective view illustrating a step of attaching caps in the manufacturing processing of the speaker device according to the embodiment.
Figure 15:
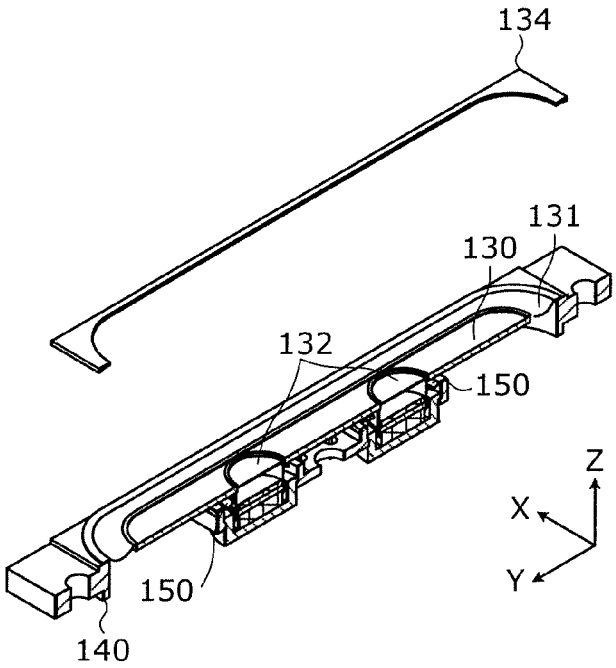
FIG. 15 is a cross-sectional perspective view illustrating a step of attaching a gasket in the manufacturing processing of the speaker device according to the embodiment.
Figure 16:
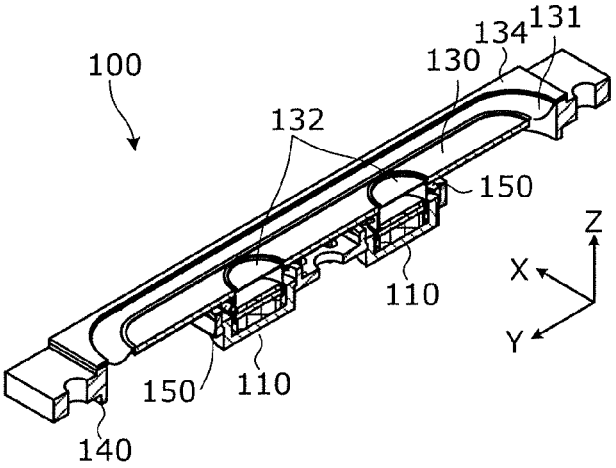
FIG. 16 is a cross-sectional perspective view illustrating the speaker device after each of the steps of attaching according to the embodiment.

Next, as illustrated in FIG. 14, caps 132 are attached to diaphragm 130 to close through holes 133. Finally, as illustrated in FIG. 15 and FIG. 16, gasket 134 is attached in such a manner that gasket 134 grips the outer peripheral edge of edge 131. Speaker device 100 is manufactured in the manner as described above.

As described above, since tongue piece 125 provided at the end portion of voice coil body 120 is formed by bending to the outside instead of the inside, it is possible to use jig 210 that fits inside voice coil body 120. Accordingly, it is possible to attach voice coil body 120 to frame 140 via damper 150, in a state in which jig 210 is attached to magnetic circuit 110. Furthermore, by using diaphragm 130 including through hole 133 through which jig 210 can be inserted, it is possible to attach voice coil body 120 to diaphragm 130 in a state in which jig 210 is inserted thereto.

In the manner as described above, it is possible to perform the attaching operation of voice coil body 120 in a state in which the appropriate position of voice coil body 120 with respect to the magnetic gap of magnetic circuit 110 is maintained. It is thus possible to easily manufacture speaker device 100 in which voice coil body 120 is arranged at an appropriate position with respect to the magnetic gap.

It should be noted that the present disclosure is not limited to the above-described embodiment. For example, another embodiment which is realized by arbitrarily combining the structural components described in this specification, or excluding one or more of the structural components may be an embodiment of the present disclosure. In addition, the present disclosure also covers variations obtained by applying a variety of modifications conceived by persons skilled in the art to the above-mentioned embodiment, without departing from the gist of the present disclosure, namely, the scope of claims.

For example, in the direction in which magnetic circuits 110 are aligned, the two voice coil bodies 120 may be respectively attached to vibration nodes of diaphragm 130.

In addition, tongue piece 125 included in bobbin 122 may be bent so as to be closer to diaphragm 130 as moving toward the outside in the radial direction.

Furthermore, voice coil body 120 may include eight or more tongue pieces 125.

Moreover, diaphragm 130 may include through hole 133 communicating with bobbin 122, and cap 132 that covers through hole 133.

In addition, diaphragm 130 may include a core layer and skin layers provided on both surfaces of the core layer.

Furthermore, the core layer may include one of a resin and a foamed resin, or a combination of a resin and a foamed resin.

In addition, the core layer may have a honeycomb structure.

In addition, the skin layer may include any one of metal, paper, resin, or fiber reinforced resin, or a combination thereof.

Dampers 150 that include dividing portions 154 may be arranged to be plane-symmetric.

All the openings of frame 140 communicating with dividing portion 154 may be provided with a cover that prevents intrusion of dust.

In addition, although dividing portion 154 and extension portion 124 are arranged to face each other, dividing portion 154 and extension portion 124 may be arranged to be back to back. In other words, the two bobbins 122 may be provided between the two dividing portions 154 and extension portions 124.

Moreover, although main body 211 of jig 210 has a length long enough to protrude from the attached diaphragm 130 in the above-described case, the length of main body 211 of jig 210 is not particularly limited, and may be short enough not to protrude from the attached voice coil body 120.

In addition, although the diameter of through hole 133 provided in diaphragm 130 is larger than the outer diameter of main body 211 of jig 210 in the above-described case, main body 211 of jig 210 and through hole 133 of diaphragm 130 may be arranged to be in a fitted state. In this case, it is possible to determine the position of diaphragm 130 by using jig 210.

Further Information about Technical Background to this Application

The disclosures of the following Japanese Patent Applications including specifications, drawings and claims are incorporated herein by reference in their entirety: Japanese Patent Application No. 2019-058470 filed on Mar. 26, 2019 and Japanese Patent Application No. 2019-058445 filed on Mar. 26, 2019.

Industrial Applicability

The present disclosure is useful for a relatively thin speaker device.

What is claimed is:

1. A speaker device, comprising:

two magnetic circuits arranged side by side and each including a magnetic gap;

two voice coil bodies each corresponding to a shape of the magnetic gap and arranged in the magnetic gap in an inserted state;

a diaphragm to which the two voice coil bodies are coupled, the diaphragm having a width shorter than a length in a direction in which the two magnetic circuits are arranged; and a frame to which the diaphragm and the two magnetic circuits are attached, wherein the two voice coil bodies respectively include extension portions from which signal wires extend, the two voice coil bodies are arranged with the extension portions facing each other, and the two voice coil bodies include two coils connected in series, the two coils being connected to a pair of input terminals for receiving an input of an electric signal, the pair of input terminals being disposed between the two voice coil bodies.

2. The speaker device according to claim 1, wherein the diaphragm has an elongated plate-like shape, and a distance from a center to an edge of the diaphragm in a longitudinal direction is in a range of from 2.27 times or more to 2.74 times or less a length from the center of the diaphragm to a winding axis of one of the two voice coil bodies.

3. The speaker device according to claim 1, wherein a cross-sectional shape of each of the two coils perpendicular to a winding axis direction is one of an ellipse, an oval, and a rectangle with rounded corners.

4. The speaker device according to claim 1, wherein winding directions of the two coils are same.

5. The speaker device according to claim 1, wherein magnetization directions of the two magnetic circuits are same.

6. The speaker device according to claim 1, further comprising:

a damper that has an annular shape and includes dividing portions, the dividing portions dividing the damper in a circumferential direction and being arranged such that the signal wires pass through the dividing portions.

7. A speaker device, comprising:

two magnetic circuits arranged side by side and each including a magnetic gap;

two voice coil bodies each corresponding to a shape of the magnetic gap and arranged in the magnetic gap in an inserted state;

a diaphragm to which the two voice coil bodies are coupled, the diaphragm having a width shorter than a length in a direction in which the two magnetic circuits are arranged; and a frame to which the diaphragm and the two magnetic circuits are attached, wherein the two voice coil bodies each include tongue pieces that are end portions of a bobbin, and are attached to the diaphragm by being bent outwardly in a radial direction, and the two voice coil bodies include two coils connected in series, the two coils being connected to a pair of input terminals for receiving an input of an electric signal, the pair of input terminals being disposed between the two voice coil bodies.

8. The speaker device according to claim 7, wherein the diaphragm has an elongated plate-like shape, and among the tongue pieces: a tongue piece that protrudes in a width direction of the diaphragm is shorter than a tongue piece that protrudes in a longitudinal direction of the diaphragm; or no tongue piece that protrudes in the width direction is included.

9. The speaker device according to claim 7, wherein the diaphragm has an elongated plate-like shape, and a distance from a center to an edge of the diaphragm in a longitudinal direction is in a range of from 2.27 times or more to 2.74 times or less a length from the center of the diaphragm to a winding axis of one of the two voice coil bodies.

10. The speaker device according to claim 7, wherein a cross-sectional shape of each of the two coils perpendicular to a winding axis direction is one of an ellipse, an oval, and a rectangle with rounded corners.

11. The speaker device according to claim 7, wherein winding directions of the two coils are same.

12. The speaker device according to claim 7, wherein magnetization directions of the two magnetic circuits are same.

* * * * *